US006793876B2

(12) United States Patent
Kawakami et al.

(10) Patent No.: US 6,793,876 B2
(45) Date of Patent: Sep. 21, 2004

(54) PRODUCTION PROCESS FOR FE-BASED SINTERED ALLOY VALVE SEAT

(75) Inventors: Atsushi Kawakami, Niigata (JP); Kazuyuki Hoshino, Niigata (JP); Kunio Hanata, Niigata (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 10/677,137

(22) Filed: Sep. 30, 2003

(65) Prior Publication Data

US 2004/0131492 A1 Jul. 8, 2004

(30) Foreign Application Priority Data

Oct. 2, 2002 (JP) ..... 2002-289577

(51) Int. Cl.[7] ..... B22F 3/26

(52) U.S. Cl. ..... 419/27; 419/11; 75/243; 75/246

(58) Field of Search ..... 419/11, 27; 75/243, 75/246

(56) References Cited

U.S. PATENT DOCUMENTS

| | | | | |
|---|---|---|---|---|
| 4,552,590 A | * | 11/1985 | Nakata et al. | 75/246 |
| 4,734,968 A | * | 4/1988 | Kuroishi et al. | 419/27 |
| 5,529,602 A | * | 6/1996 | Ishii et al. | 75/231 |
| 5,759,227 A | * | 6/1998 | Takahashi et al. | 75/246 |
| 6,082,317 A | | 7/2000 | Takahashi et al. | |

FOREIGN PATENT DOCUMENTS

| | | |
|---|---|---|
| EP | 0 965 653 A1 | 12/1999 |
| JP | 08-193250 A1 | 7/1996 |
| JP | 11-209855 A1 | 8/1999 |
| JP | 05-287463 A1 | 11/1999 |

OTHER PUBLICATIONS

Patent Abstracts of Japan; vol. 1999, No. 13, Nov. 30, 1999 & JP 11 209855 A (Mitsubishi Materials Corp), Aug. 3, 1999 *abstract*.

Patent Abstracts of Japan; vol. 018, No. 082 (C–1164), Feb. 10, 1994 & JP 05 287463 A (Nissan Motor Co Ltd; Others: 01), Nov. 2, 1993 *abstract*.

Patent Abstracts of Japan; vol. 1996, No. 11, Nov. 29, 1996 & JP 08 193250 A (Hitachi Powdered Metals Co Ltd; Nissan Motor Co Ltd) Jul. 30, 1996 *abstract*.

* cited by examiner

*Primary Examiner*—Ngoclan T. Mai
(74) *Attorney, Agent, or Firm*—Darby & Darby

(57) ABSTRACT

A valve seat is produced by (a) using, as a raw material powder for forming a matrix, an Fe-based alloy powder with an average particle size of 20 to 50 μm, and using, as a raw material powder for forming a hard dispersion phase, a Co-based alloy powder with an average particle size of 20 to 50 μm, (b) conducting solid phase sintering, under vacuum, of a pressed compact formed from a mixed powder generated by mixing the Co-based alloy powder into the Fe-based alloy powder in sufficient quantity to account for 25 to 35% by weight of the combined weight with the Fe-based alloy powder, and causing the Co, Cr and Si components of the Co-based alloy powder to diffuse and migrate into the matrix, and the Fe component of the Fe-based alloy powder to diffuse and migrate concurrently into the hard dispersion phase, thereby markedly improving adhesion of the hard dispersion phase to the matrix, and forming, as a result, an Fe-based sintered alloy substrate with a porosity of 10 to 20%, and comprising an Fe—Co alloy matrix in which is uniformly distributed a hard dispersion phase of a Mo—Fe—Co alloy having a 2 phase mixed system of an Fe—Co alloy phase and a Mo—Co alloy phase, and (c) infiltrating this Fe-based sintered alloy substrate with copper or a copper alloy.

2 Claims, No Drawings

PRODUCTION PROCESS FOR FE-BASED SINTERED ALLOY VALVE SEAT

BACKGROUND OF THE INVENTION

1. Field of the Invention

The present invention relates to a valve seat, which is a structural member of an internal combustion engine such as a diesel engine or a gasoline engine, and relates particularly to an Fe-based sintered alloy valve seat (hereafter simply described as a valve seat) that exhibits excellent wear resistance under conditions of high surface pressure application.

2. Description of the Related Art

The cylinder heads of internal combustion engines such as diesel engines or gasoline engines are provided with valve seats for the exhaust valve and the intake valve.

Conventionally, the valve seats utilize an Fe-based sintered alloy which has an overall composition comprising, in terms of weight percentage (hereafter all % values relating to compositions refer to % by weight), C: 0.7 to 1.4%, Si: 0.2 to 0.9%, Co: 15.1 to 26%, Mo: 6.1 to 11%, Cr: 2.6 to 4.7%, Ni: 0.5 to 1.2%, Nb: 0.2 to 0.7%, and a balance of Fe and inevitable impurities, wherein a substrate formed from an Fe-based sintered alloy, comprising a composition in which a hard dispersion phase formed from Co—Mo—Cr alloy is distributed in an Fe-based alloy matrix, and having a porosity of 5 to 15%, is infiltrated with copper or copper alloy to form the valve seat (for example, refer to the patent reference 1).

Furthermore, it is known that the valve seat described above can be produced using, as the raw material powder for forming the matrix, an Fe-based alloy powder with an average particle size of 75 to 107 μm, and comprising:

C: 0.8 to 2.1%,

Ni: 0.6 to 1.7%,

Cr: 1.2 to 3.6%,

Nb: 0.3 to 0.9%,

Co: 4.3 to 13%,

Mo: 1.4 to 4.2%, and a balance of Fe and inevitable impurities, and using, as the raw material powder for forming the hard dispersion phase, a Co-based alloy powder with an average particle size of 68 to 102 μm, and comprising:

Mo: 20 to 35%,

Cr: 5 to 10%,

Si: 1 to 4%, and a balance of Co and inevitable impurities, by conducting solid phase sintering, in an ammonia cracked gas atmosphere, of a pressed compact formed from a mixed powder generated by mixing the Co-based alloy powder into the Fe-based alloy powder in sufficient quantity to account for 25 to 35% by weight of the combined weight with the Fe-based alloy powder, thereby forming an Fe-based sintered alloy substrate, and then infiltrating this Fe-based sintered alloy substrate with copper or a copper alloy (refer to patent reference 1).

Patent Reference 1

Japanese Unexamined Patent Application, First Publication No. Hei 11-209855 A

On the other hand, the increase in the size and output of internal combustion engines in recent years has been remarkable, and accompanying these trends, the spring constant of the valve springs have tended to increase with the aim of preventing gas leakage of the combustion gases. As a result, the seat load applied to the valve contact surface of the valve seat increases even further, meaning operation of the valve seat under conditions of high surface pressure application is unavoidable, but when a conventional valve seat such as that described above, or any of a variety of other valve seats, is used under conditions of high surface pressure application, wear of the valve seat is accelerated considerably, meaning the valve seat reaches the end of its life in a comparatively short time.

SUMMARY OF THE INVENTION

Taking the above circumstances into consideration, the inventors of the present invention conducted research into developing a valve seat that exhibits excellent wear resistance, even when used under conditions of high surface pressure application, and made the following discoveries (a) to (c).

(a) The reason that the conventional valve seat described above displays inadequate wear resistance under conditions of high surface pressure application is that because the adhesion of the hard dispersion phase to the matrix is unsatisfactory, the hard dispersion phase readily separates from the matrix under conditions of high surface pressure application, causing an acceleration of the wearing process.

(b) The Fe-based sintered alloy substrate used to form the conventional valve seat described above is produced, as described above, using an Fe-based alloy powder for forming the matrix, and a Co-based alloy powder for forming the hard dispersion phase, both with an average particle size of 68 to 107 μm, by conducting sintering in an ammonia cracked gas atmosphere, and as a result, in the Fe-based sintered alloy substrate generated following sintering, the matrix has essentially the same composition as that of the Fe-based alloy powder used for forming the matrix, and similarly, the hard dispersion phase has essentially the same composition as that of the Co-based alloy powder used for forming the hard dispersion phase, whereas if the sintering atmosphere is altered to a vacuum atmosphere (a reduced pressure atmosphere), and the particle sizes of the raw material powder for forming the matrix and the raw material powder for forming the hard dispersion phase are reduced to average particle sizes within a range from 20 to 50 μm, and in addition, if the raw material powder for forming the matrix utilizes an Fe-based alloy powder comprising:

C: 0.5 to 1.5%,

Ni: 0.1 to 3%,

Mo: 0.5 to 3%,

Co: 3 to 8%,

Cr: 0.2 to 3%, and a balance of Fe and inevitable impurities, and the raw material powder for forming the hard dispersion phase utilizes a Co-based alloy powder comprising:

Mo: 20 to 32%,

Cr: 5 to 10%,

Si: 0.5 to 4%, and a balance of Co and inevitable impurities, then during sintering, the Co, Cr and Si components of the Co-based alloy powder diffuse and migrate into the matrix, and the Fe component of the Fe-based alloy powder diffuses and migrates concurrently into the gaps in the Co-based alloy powder left by the migration of the Co, Cr and Si components, thereby generating a mutual diffusion and migration phenomenon of the alloy components.

(c) The Fe-based sintered alloy substrate generated during the sintering described in (b) above, in which the alloy components have undergone mutual dispersion and migration between the matrix and the hard dispersion phase, is formed from an Fe-based sintered alloy with a porosity of 10 to 20%, and comprising, according to measurements performed using an X-ray microanalyzer (EPMA), an Fe—Co alloy matrix comprising:

C: 0.5 to 1.5%,

Ni: 0.1 to 3%,

Mo: 0.5 to 3%,

Co: 13 to 22%,

Cr: 1 to 5%,

Si: 0.1 to 1%, and a balance of Fe and inevitable impurities, in which is uniformly distributed a hard dispersion phase of a Mo—Fe—Co alloy, having a composition comprising:

Fe: 20 to 30%,

Co: 13 to 22%,

Cr: 1 to 5%,

Si: 0.3 to 3%, and a balance of Mo and inevitable impurities, and having a 2 phase mixed system of an Fe—Co alloy phase and a Mo—Co alloy phase, and from these findings it is evident that as a result of this mutual diffusion and migration of large quantities of the alloy components between the matrix and the hard dispersion phase, the adhesion of the hard dispersion phase to the matrix improves markedly, and moreover, the matrix displays excellent high temperature corrosion resistance in the fuel combustion gas atmosphere, and the hard dispersion phase has superior high temperature hardness and displays excellent high temperature corrosion resistance, and consequently, the Fe-based sintered alloy substrate described above exhibits excellent wear resistance as a valve seat, even under high surface pressure application conditions, and if the substrate is infiltrated with copper or a copper alloy then the thermal conductivity and the strength of the substrate can be further improved.

The findings in (a) to (c) above summarize the results of the research conducted by the inventors.

The present invention is based on the research results described above, and provides a process for producing a valve seat comprising the steps of:

(a) using, as a raw material powder for forming a matrix, an Fe-based alloy powder comprising:

C: 0.5 to 1.5%,

Ni: 0.1 to 3%,

Mo: 0.5 to 3%,

Co: 3 to 8%,

Cr: 0.2 to 3%, and a balance of Fe and inevitable impurities, and having an average particle size of 20 to 50 $\mu$m; and using, as a raw material powder for forming a hard dispersion phase, a Co-based alloy powder comprising:

Mo: 20 to 32%,

Cr: 5 to 10%,

Si: 0.5 to 4%, and a balance of Co and inevitable impurities, and having an average particle size of 20 to 50 $\mu$m, (b) conducting solid phase sintering, under vacuum, of a pressed compact formed from a mixed powder generated by mixing the Co-based alloy powder into the Fe-based alloy powder in sufficient quantity to account for 25 to 35% by weight of the combined weight with the Fe-based alloy powder, and causing the Co, Cr and Si components of the Co-based alloy powder to diffuse and migrate into the matrix, and the Fe component of the Fe-based alloy powder to diffuse and migrate concurrently into the hard dispersion phase, thereby markedly improving the adhesion of the hard dispersion phase to the matrix, and forming, as a result, an Fe-based sintered alloy substrate with a porosity of 10 to 20%, and comprising, according to measurements performed using an X-ray microanalyzer (EPMA), an Fe—Co alloy matrix comprising:

C: 0.5 to 1.5%,

Ni: 0.1 to 3%,

Mo: 0.5 to 3%,

Co: 13 to 22%,

Cr: 1 to 5%,

Si: 0.1 to 1%, and a balance of Fe and inevitable impurities, in which is uniformly distributed a hard dispersion phase of a Mo—Fe—Co alloy, having a composition comprising:

Fe: 20 to 30%,

Co: 13 to 22%,

Cr: 1 to 5%,

Si: 0.3 to 3%, and a balance of Mo and inevitable impurities, and having a 2 phase mixed system of an Fe—Co alloy phase and a Mo—Co alloy phase, and (c) infiltrating the Fe-based sintered alloy substrate with copper or a copper alloy.

As follows is a description of the reasons for restricting the compositions, average particle sizes, and mix proportions of the raw material powders, as well as the composition and porosity of the Fe-based sintered alloy substrate, to the values described above, for the process for producing a valve seat according to the present invention.

(A) Compositions of the Raw Material Powder for Forming the Matrix and the Fe-based Sintered Alloy Substrate:

(a) C

The C component in the substrate matrix following sintering is of the same content level as that of the raw material powder, and is dissolved in the matrix in a solid state, thereby strengthening the matrix, as well as forming carbides that are dispersed throughout the matrix thereby improving the wear resistance of the matrix. If a C component is also introduced into the hard dispersion phase, then it performs the function of improving the wear resistance of the hard dispersion phase. If the C content is less than 0.5%, then the actions described above do not provide the desired levels of improvement, whereas in contrast if the content exceeds 1.5%, counterpart attack increases rapidly. Accordingly, the C content was set within a range from 0.5 to 1.5%.

(b) Ni

Like the C component, the Ni component also remains in the substrate matrix, without diffusing and migrating into the hard dispersion phase, and is dissolved in the matrix in a solid state, thereby strengthening the matrix. If the Ni content is less than 0.1%, then the actions described above do not provide the desired effects, whereas in contrast if the content exceeds 3%, the strength deteriorates. Accordingly, the Ni content was set within a range from 0.1 to 3%.

(c) Mo

Like the C component and the Ni component, the Mo also remains in the substrate matrix during sintering, without diffusing and migrating into the hard dispersion phase, and is dissolved in the matrix in a solid state, while forming carbides that are dispersed throughout the matrix, thereby improving the strength and the wear resistance of the matrix. If the Mo content is less than 0.5%, then the actions described above do not provide the desired levels of improvement, whereas in contrast if the content exceeds 3%, the strength of the matrix deteriorates. Accordingly, the Mo content was set within a range from 0.5 to 3%.

(d) Co

The Co component of 3 to 8% incorporated within the raw material powder for forming the matrix combines with the large quantity of Co that diffuses and migrates from the hard dispersion phase during sintering, generating a Co content of 13 to 22% in the substrate matrix following sintering, thereby improving the high temperature corrosion resistance within the combustion gas atmosphere, whereas the diffusion and migration phenomenon described above improves the adhesion of the substrate matrix to the hard dispersion phase, thereby contributing to an improvement in wear resistance under conditions of high surface pressure application. If the Co content in the raw material powder for forming the matrix is less than 3%, then ensuring a Co content of at least 13% in the substrate matrix following sintering is extremely difficult, and the actions described above do not provide the desired effects, whereas if the Co content in the raw material powder for forming the matrix exceeds 8%, then the Co content in the substrate matrix following sintering can exceed 22% and become overly high, causing a deterioration in the wear resistance of the valve seat itself. Accordingly, the Co content of the raw material powder for forming the matrix was set within a range from 3 to 8%, and the Co content of the substrate matrix following sintering was set within a range from 13 to 22%.

(e) Cr

The Cr component of the raw material powder for forming the matrix is from 0.2 to 3%, whereas the substrate matrix following sintering incorporates from 1 to 5% due to diffusion and migration. If the Cr content in the raw material powder for forming the matrix is less than 0.2%, then the Cr content of the substrate matrix following sintering is less than 1%, and the solid solution strengthening of the matrix and the improvement in wear resistance arising from carbide formation are inadequate, whereas if the Cr content in the raw material powder for forming the matrix exceeds 3%, then the Cr content of the substrate matrix following sintering exceeds 5% and becomes overly high, causing a rapid increase in counterpart attack during application under conditions of high surface pressure application. Accordingly, the Cr content of the raw material powder for forming the matrix was set within a range from 0.2 to 3%, and the Cr content of the substrate matrix following sintering was set within a range from 1 to 5%.

(f) Si

The Si component incorporated within the substrate matrix is a component that has diffused and migrated from the hard dispersion phase during sintering, and as a result of the diffusion and migration of this Si component into the matrix substrate, the diffusion and migration of the Co component from the hard dispersion phase accelerates, and as a result, the adhesion of the hard dispersion phase to the substrate matrix improves markedly. If the Si content in the substrate matrix is less than 0.1%, then adequate diffusion and migration of the Co component into the substrate matrix may not be achievable, although the level of this migration is also related to the Si content within the raw material powder for forming the hard dispersion phase. In contrast, if the Si content in the substrate matrix exceeds 1%, then the strength of the matrix deteriorates. Accordingly, the Si content was set within a range from 0.1 to 1%.

(B) Compositions of the Raw Material Powder for Forming the Hard Dispersion Phase and the Substrate Hard Dispersion Phase (a) Mo The Mo component of the raw material powder for forming the hard dispersion phase forms a hard Mo—Co alloy phase that represents one component phase of the two phase mixture of the substrate hard dispersion phase formed following sintering, and has a function of improving the wear resistance. If the content of the Mo component is less than 20% then the proportion of the Fe—Co alloy phase that represents the other component phase becomes overly large, and the desired level of superior wear resistance cannot be ensured, whereas in contrast, if the Mo content exceeds 32%, then the sintering properties deteriorate, and achieving the desired strength for the valve seat becomes impossible. Accordingly, the Mo content of the raw material powder for forming the hard dispersion phase was set within a range from 20 to 32%.

(b) Cr

The Cr content of the raw material powder for forming the hard dispersion phase is from 5 to 10%, and a portion of this Cr component diffuses and migrates into the substrate matrix during sintering, producing a Cr content of 1 to 5% in the substrate matrix. If the Cr content in the raw material powder for forming the hard dispersion phase is less than 5%, then a Cr content of at least 1% in the substrate matrix following sintering cannot be achieved, and in such a case, as described above, the solid solution strengthening of the matrix and the improvement in wear resistance arising from carbide formation are inadequate. In contrast, if the Cr content in the raw material powder for forming the hard dispersion phase exceeds 10%, then the Cr content in the substrate matrix exceeds 5% and becomes overly high, causing a rapid increase in counterpart attack during application under conditions of high surface pressure application. Accordingly, the Cr content of the raw material powder for forming the hard dispersion phase was set within a range from 5 to 10%, and the Cr content of the substrate matrix following sintering was set within a range from 1 to 5%.

(c) Fe

The Fe component in the substrate hard dispersion phase is formed by diffusion and migration from the raw material powder for forming the matrix during sintering, and forms a very tough Fe—Co alloy phase that represents one component phase of the two phase mixture of the substrate hard dispersion phase, and this Fe—Co phase moderates the counterpart attack caused by the hard Mo—Co alloy phase under conditions of high surface pressure application. If the Fe content of the substrate hard dispersion phase is less than 20%, then the proportion of the Mo—Co alloy phase becomes overly large, and the desired level of counterpart attack moderation cannot be ensured, whereas in contrast, if the Fe content exceeds 30%, then the hardness of the substrate hard dispersion phase decreases, causing a deterioration in the wear resistance of the valve seat. Accordingly, the Fe content of the substrate hard dispersion phase was set within a range from 20 to 30%.

(d) Co

The Co component within the raw material powder for forming the hard dispersion phase forms the hard Mo—Co alloy phase and the very tough Fe—Co alloy phase, which represent the two component phases of the two phase mixture of the substrate hard dispersion phase formed following sintering, and this Co component improves the wear resistance while exhibiting a moderating effect on the counterpart attack properties. If the Co content of the substrate hard dispersion phase following sintering is less than 13%, then the strength of the Mo—Fe—Co alloy phase that comprises the 2 phase mixed system of the Mo—Co alloy phase and the Fe—Co alloy phase deteriorates, and the desired level of superior wear resistance for the valve seat cannot be ensured. In contrast, if the Co content exceeds 22%, then the hardness of the matrix hard dispersion phase itself deteriorates, and this also means that the desired level of superior wear resistance for the valve seat cannot be ensured. Accordingly, the Co content of the substrate hard dispersion phase was set within a range from 13 to 22%.

(e) Si

As described above, the Si component within the raw material powder for forming the hard dispersion phase undergoes diffusion and migration itself, and also promotes the diffusion and migration of the Co and Cr components in the raw material powder into the substrate matrix during sintering, thereby markedly improving the adhesion of the hard dispersion phase to the substrate matrix. If the Si content is less than 0.5%, then the diffusion and migration of the Co and Cr components into the substrate matrix is inadequate, making it impossible to ensure an excellent level of adhesion between the hard dispersion phase and the matrix. In contrast if the Si content exceeds 4%, then the Si component incorporated within the substrate matrix exceeds 1%, causing a deterioration in the strength of the substrate matrix. Accordingly, the Si content of the raw material powder for forming the hard dispersion phase was set within a range from 0.5 to 4% (resulting in a Si content of the substrate hard dispersion phase following sintering within a range from 0.3 to 3%).

(C) Raw Material Powders (a) Average Particle Sizes

The average particle sizes for both the raw material powder for forming the matrix and the raw material powder for forming the hard dispersion phase are within a range from 20 to 50 μm. If the average particle size is either less than 20 μm, or greater than 50 μm, then the diffusion and migration of the Co component from the raw material powder for forming the hard dispersion phase into the substrate matrix become difficult, meaning the mutual diffusion and migration of the Fe component from the raw material powder for forming the matrix into the hard dispersion phase is also unsatisfactory. As a result, the adhesion of the hard dispersion phase to the substrate matrix following sintering is unsatisfactory, and wear progresses at a markedly quicker rate under conditions of high surface pressure application. Accordingly, the average particle size of each of the raw material powders was set within a range from 20 to 50 μm.

(b) Mix Proportion of the Raw Material Powder for forming the Hard Dispersion Phase If the mix proportion of the raw material powder for forming the hard dispersion phase is less than 25% by weight, then the desired level of wear resistance cannot be ensured, whereas if the mix proportion exceeds 35% by weight, then not only does the counterpart attack increase rapidly, but the strength also decreases. Accordingly, this mix proportion for the raw material powder for forming the hard dispersion phase was set within a range from 25 to 35% by weight relative to the combined quantity with the raw material powder for forming the matrix.

(D) Porosity of the Fe-based Sintered Alloy Substrate

If this porosity is less than 5%, infiltration of copper and copper alloys is non-uniform, and the effect of this infiltration is not adequately displayed, whereas if the porosity exceeds 15%, then reductions in the strength and wear resistance become unavoidable. Accordingly, the porosity was set within a range from 5 to 15%.

(E) The Aforementioned Vacuum Refers to an Atmosphere of no More than 100 Pa. The temperature range for the sintering is preferably from 1100 to 1250° C., and the time for which the sintering temperature is maintained is preferably from 0.5 to 2 hours.

DETAILED DESCRIPTION OF THE PREFERRED EMBODIMENTS

As follows is a more detailed description of the process for producing a valve seat according to the present invention, based on a series of examples.

First, raw material powders for forming a matrix M-1 to M-11, and raw material powders for forming a hard dispersion phase H-1 to H-7, with the average particle sizes and compositions shown in Table 1 and Table 2 respectively, were prepared. These raw material powders were mixed in the combinations and proportions shown in Table 3, 1% of zinc stearate was added to each sample mixture, the samples were mixed for 30 minutes in a mixer, and each mixed powder was press molded into a green compact at a predetermined pressure within a range from 600 to 800 MPa. Each pressed green compact was held at 500° C. for 30 minutes and degreased, and was then sintered under vacuum conditions of no more than 100 Pa, by holding the green compact at a predetermined temperature within a range from 1130 to 1250° C. for a period of 1 hour, thereby forming an Fe-based sintered alloy substrate. At this point, compositional analyses of the matrix and the hard dispersion phase of the Fe-based sintered alloy substrate were performed using an X-ray microanalyzer, the porosity was measured, and the structure of the alloy was inspected under an optical microscope. Subsequently, processes 1 to 11 of the present invention were completed by subjecting each Fe-based sintered alloy substrate to copper infiltration treatment in a methane denatured gas atmosphere under conditions including a temperature of 1100° C. and a retention time of 15 minutes, thereby producing valve seats (hereafter, the valve seats produced in accordance with the processes 1 to 11 of the present invention are referred to as valve seats 1 to 11 of the present invention), each of which had dimensions including external diameter: 42 mm×minimum internal diameter 34.5 mm×thickness 6.5 mm.

The measurement results for the Fe-based sintered alloy substrates of each of the valve seats 1 to 11 of the present invention are shown in Table 4. Furthermore, each of the Fe-based sintered alloy substrates displayed a similar structure, comprising an austenite matrix with fine carbides dispersed and distributed therein, with a Mo—Fe—Co alloy hard dispersion phase, having a 2 phase mixed system of an Fe—Co alloy phase and a Mo—Co alloy phase, distributed uniformly therein.

For the purposes of comparison, comparative processes 1 to 11 were carried out under the same conditions as those of the processes 1 to 11 of the present invention, with the exceptions of using raw material powders for forming a matrix m-1 to m-1, and raw material powders for forming a hard dispersion phase h-1 to h-7, with the average particle sizes and compositions shown in Table 5 and Table 6 respectively (the compositions were the same as the raw material powders M-1 to M-11 and H-1 to H-7 described above), combining these raw material powders in the combinations and proportions shown in Table 7, and altering the sintering atmosphere to an ammonia cracked gas atmosphere, thereby producing a series of valve seats (hereafter, the valve seats produced in accordance with the comparative processes 1 to 11 are referred to as comparative valve seats 1 to 11).

The results of measuring the compositions of the matrix and the hard dispersion phase, and measuring the porosity of the Fe-based sintered alloy substrate of each of the comparative valve seats 1 to 11 are shown in Table 8. Furthermore, each of the Fe-based sintered alloy substrates displayed a similar structure, comprising a ferrite matrix with fine carbides distributed therein, with a single Co—Mo—Cr alloy hard dispersion phase distributed uniformly therein.

Subsequently, each of the produced valve seats was assembled in a diesel engine with a displacement of 8000 cc. Running tests were conducted using high surface pressure application conditions by operating the engine under the following conditions, and then measuring the maximum wear depth of the valve seat and the maximum wear depth of the counterpart valve. The results of these measurements are shown in Table 9.

Valve material: stellite

Cylinder internal pressure: 17.6 MPa

Valve spring load: 600 MPa

Engine revolutions: 3000 rpm

Operating time: 500 hours

Operating conditions: constant revolutions for 500 hours

TABLE 1

| Type | | Average particle size (μm) | Composition (% by weight) C | Ni | Mo | Co | Cr | Fe + impurities |
|---|---|---|---|---|---|---|---|---|
| Raw material powder for forming the matrix | M-1 | 35.2 | 0.53 | 1.56 | 1.65 | 5.49 | 1.63 | balance |
| | M-2 | 28.6 | 0.98 | 1.49 | 1.71 | 5.51 | 1.57 | balance |
| | M-3 | 42.7 | 1.47 | 1.55 | 1.68 | 5.60 | 1.60 | balance |
| | M-4 | 49.5 | 1.04 | 0.12 | 1.65 | 5.64 | 1.58 | balance |
| | M-5 | 20.8 | 1.01 | 2.96 | 1.59 | 5.59 | 1.61 | balance |
| | M-6 | 33.8 | 0.99 | 1.58 | 0.51 | 5.71 | 1.57 | balance |
| | M-7 | 29.4 | 1.03 | 1.49 | 2.97 | 5.65 | 1.64 | balance |
| | M-8 | 37.1 | 0.97 | 1.53 | 1.50 | 3.10 | 1.62 | balance |
| | M-9 | 40.9 | 0.95 | 1.56 | 1.56 | 7.95 | 1.55 | balance |
| | M-10 | 31.3 | 1.07 | 1.49 | 1.66 | 5.66 | 0.23 | balance |
| | M-11 | 45.1 | 1.02 | 1.60 | 1.63 | 5.58 | 2.98 | balance |

TABLE 2

| Type | | Average particle size (μm) | Composition (% by weight) Mo | Cr | Si | Co + impurities |
|---|---|---|---|---|---|---|
| Raw material powder for forming the hard dispersion phase | H-1 | 28.5 | 20.3 | 7.53 | 2.23 | balance |
| | H-2 | 42.3 | 26.1 | 7.49 | 2.28 | balance |
| | H-3 | 39.7 | 31.7 | 7.37 | 2.26 | balance |
| | H-4 | 49.2 | 25.9 | 5.08 | 2.21 | balance |
| | H-5 | 33.8 | 25.6 | 9.87 | 2.27 | balance |
| | H-6 | 20.5 | 26.0 | 7.55 | 0.52 | balance |
| | H-7 | 35.4 | 25.6 | 7.46 | 3.94 | balance |

TABLE 3

| Type | | Combination: Code for raw material powder for forming the matrix | Code for raw material powder for forming the hard dispersion phase | Mix proportion of the raw material powder for forming the hard dispersion phase (% by weight) |
|---|---|---|---|---|
| Present invention process number | 1 | M-1 | H-1 | 25 |
| | 2 | M-2 | H-2 | 35 |
| | 3 | M-3 | H-3 | 30 |
| | 4 | M-4 | H-4 | 28 |
| | 5 | M-5 | H-5 | 32 |
| | 6 | M-6 | H-6 | 26 |
| | 7 | M-7 | H-7 | 28 |
| | 8 | M-8 | H-1 | 34 |
| | 9 | M-9 | H-2 | 31 |
| | 10 | M-10 | H-3 | 29 |
| | 11 | M-11 | H-4 | 33 |

TABLE 4

| Type | | Fe-based sintered alloy substrate: Matrix composition (% by weight) C | Ni | Mo | Co | Cr | Si | Fe + impurities | Hard dispersion phase composition (% by weight) Fe | Co | Cr | Si | Mo + impurities | Porosity (%) |
|---|---|---|---|---|---|---|---|---|---|---|---|---|---|---|
| Present invention process number (valve seat number) | 1 | 0.50 | 1.38 | 1.92 | 17.46 | 2.64 | 0.52 | balance | 26.23 | 17.46 | 2.64 | 0.98 | balance (50.38) | 15.8 |
| | 2 | 0.95 | 1.26 | 2.03 | 18.52 | 2.47 | 0.63 | balance | 29.41 | 18.52 | 2.47 | 1.02 | balance (48.85) | 14.2 |
| | 3 | 1.46 | 1.38 | 2.01 | 17.83 | 2.55 | 0.48 | balance | 22.56 | 17.83 | 2.55 | 1.13 | balance (54.13) | 16.5 |
| | 4 | 0.98 | 0.11 | 1.95 | 17.96 | 2.58 | 0.51 | balance | 23.42 | 17.96 | 2.58 | 0.97 | balance (53.62) | 15.3 |
| | 5 | 0.95 | 2.89 | 1.89 | 18.13 | 2.43 | 0.55 | balance | 26.34 | 18.13 | 2.43 | 1.24 | balance (50.04) | 17.7 |
| | 6 | 0.93 | 1.35 | 0.61 | 17.40 | 2.33 | 0.11 | balance | 25.11 | 17.40 | 2.33 | 0.32 | balance (53.28) | 13.1 |
| | 7 | 0.97 | 1.33 | 2.99 | 18.24 | 2.67 | 0.98 | balance | 25.75 | 18.24 | 2.67 | 2.87 | balance (48.71) | 19.0 |
| | 8 | 0.91 | 1.34 | 1.82 | 13.12 | 2.51 | 0.43 | balance | 24.65 | 13.12 | 2.51 | 1.33 | balance (55.96) | 10.8 |
| | 9 | 0.89 | 1.37 | 1.90 | 21.85 | 2.52 | 0.62 | balance | 26.92 | 21.85 | 2.52 | 0.86 | balance (45.57) | 18.6 |
| | 10 | 1.00 | 1.29 | 1.94 | 18.21 | 1.03 | 0.50 | balance | 20.38 | 18.21 | 1.03 | 1.05 | balance (56.30) | 13.2 |
| | 11 | 0.96 | 1.42 | 1.93 | 17.95 | 4.94 | 0.47 | balance | 24.59 | 17.95 | 4.84 | 0.90 | balance (51.25) | 12.9 |

TABLE 5

| Type | | Average particle size (μm) | Composition (% by weight) C | Ni | Mo | Co | Cr | Fe + impurities |
|---|---|---|---|---|---|---|---|---|
| Raw material powder for forming the matrix | m-1 | 78 | Same as the matrix forming raw material powder M-1 | | | | | |
| | m-2 | 83 | Same as the matrix forming raw material powder M-2 | | | | | |
| | m-3 | 78 | Same as the matrix forming raw material powder M-3 | | | | | |
| | m-4 | 105 | Same as the matrix forming raw material powder M-4 | | | | | |
| | m-5 | 86 | Same as the matrix forming raw material powder M-5 | | | | | |
| | m-6 | 83 | Same as the matrix forming raw material powder M-6 | | | | | |
| | m-7 | 75 | Same as the matrix forming raw material powder M-7 | | | | | |
| | m-8 | 98 | Same as the matrix forming raw material powder M-8 | | | | | |
| | m-9 | 99 | Same as the matrix forming raw material powder M-9 | | | | | |
| | m-10 | 83 | Same as the matrix forming raw material powder M-10 | | | | | |
| | m-11 | 75 | Same as the matrix forming raw material powder M-11 | | | | | |

TABLE 6

| Type | | Average particle size (μm) | Composition (% by weight) Mo | Cr | Si | Co + impurities |
|---|---|---|---|---|---|---|
| Raw material powder for forming the hard dispersion | h-1 | 68 | Same as the hard dispersion phase forming raw material powder H-1 | | | |
| | h-2 | 77 | Same as the hard dispersion phase forming raw material powder H-2 | | | |

TABLE 6-continued

| Type | | Average particle size (μm) | Composition (% by weight) Mo | Cr | Si | Co + impurities |
|---|---|---|---|---|---|---|
| phase | h-3 | 102 | Same as the hard dispersion phase forming raw material powder H-3 | | | |
| | h-4 | 84 | Same as the hard dispersion phase forming raw material powder H-4 | | | |
| | h-5 | 76 | Same as the hard dispersion phase forming raw material powder H-5 | | | |
| | h-6 | 93 | Same as the hard dispersion phase forming raw material powder H-6 | | | |
| | h-7 | 94 | Same as the hard dispersion phase forming raw material powder H-7 | | | |

TABLE 7

| Type | | Combination: Code for raw material powder for forming the matrix | Code for raw material powder for forming the hard dispersion phase | Mix proportion of the raw material powder for forming the hard dispersion phase (% by weight) |
|---|---|---|---|---|
| Comparative process number | 1 | m-1 | h-1 | 25 |
| | 2 | m-2 | h-2 | 35 |
| | 3 | m-3 | h-3 | 30 |
| | 4 | m-4 | h-4 | 28 |
| | 5 | m-5 | h-5 | 32 |
| | 6 | m-6 | h-6 | 26 |
| | 7 | m-7 | h-7 | 28 |
| | 8 | m-8 | h-1 | 34 |
| | 9 | m-9 | h-2 | 31 |
| | 10 | m-10 | h-3 | 29 |
| | 11 | m-11 | h-4 | 33 |

TABLE 8

| Type | | Fe-based sintered alloy substrate | | | | | | | | | | | | |
|---|---|---|---|---|---|---|---|---|---|---|---|---|---|---|
| | | Matrix composition (% by weight) | | | | | | | Hard dispersion phase composition (% by weight) | | | | | |
| | | C | Ni | Mo | Co | Cr | Si | Fe + impurities | Fe | Co | Cr | Si | Mo + impurities | Porosity (%) |
| Comparative process number (comparative valve seat number) | 1 | 0.48 | 1.35 | 1.90 | 6.38 | 2.03 | 0.25 | balance | 5.24 | 42.64 | 4.24 | 1.42 | balance (44.54) | 16.1 |
| | 2 | 0.96 | 1.30 | 2.08 | 6.52 | 1.88 | 0.28 | balance | 6.43 | 44.25 | 5.37 | 1.27 | balance (40.65) | 14.0 |
| | 3 | 1.45 | 1.42 | 1.98 | 6.80 | 1.95 | 0.22 | balance | 3.26 | 43.62 | 4.38 | 1.45 | balance (45.91) | 16.3 |
| | 4 | 0.99 | 0.12 | 1.92 | 6.72 | 1.92 | 0.30 | balance | 4.33 | 41.38 | 3.96 | 1.38 | balance (46.32) | 15.2 |
| | 5 | 0.97 | 2.91 | 1.86 | 6.43 | 1.86 | 0.24 | balance | 5.78 | 43.72 | 7.52 | 1.62 | balance (39.83) | 17.5 |
| | 6 | 0.93 | 1.37 | 0.54 | 6.95 | 1.95 | 0.04 | balance | 4.21 | 42.50 | 4.34 | 0.59 | balance (46.28) | 13.4 |
| | 7 | 0.98 | 1.34 | 2.95 | 6.58 | 2.11 | 0.49 | balance | 5.54 | 43.82 | 4.71 | 3.18 | balance (36.74) | 19.2 |
| | 8 | 0.92 | 1.36 | 1.80 | 4.25 | 1.93 | 0.21 | balance | 4.62 | 37.15 | 3.88 | 1.42 | balance (50.67) | 10.7 |
| | 9 | 0.91 | 1.39 | 1.85 | 9.62 | 1.74 | 0.32 | balance | 6.85 | 45.70 | 4.66 | 1.30 | balance (39.96) | 18.2 |
| | 10 | 1.02 | 1.33 | 1.89 | 6.77 | 0.86 | 0.22 | balance | 2.06 | 41.54 | 4.78 | 1.43 | balance (48.18) | 13.6 |
| | 11 | 0.97 | 1.45 | 1.90 | 6.23 | 3.57 | 0.25 | balance | 4.95 | 40.59 | 3.23 | 1.56 | balance (47.75) | 12.7 |

TABLE 9

| Type | | Maximum wear thickness (μm) | Valve maximum wear thickness (μm) |
|---|---|---|---|
| Present invention Valve Seat | 1 | 24 | 16 |
| | 2 | 38 | 17 |
| | 3 | 12 | 8 |
| | 4 | 15 | 7 |
| | 5 | 30 | 12 |
| | 6 | 26 | 21 |
| | 7 | 11 | 9 |
| | 8 | 21 | 18 |
| | 9 | 28 | 13 |
| | 10 | 32 | 11 |
| | 11 | 17 | 24 |
| Comparative Valve Seat | 1 | 76 | 53 |
| | 2 | 85 | 61 |
| | 3 | 127 | 44 |
| | 4 | 98 | 65 |
| | 5 | 154 | 97 |
| | 6 | 115 | 74 |
| | 7 | 110 | 38 |
| | 8 | 88 | 29 |
| | 9 | 72 | 50 |
| | 10 | 105 | 72 |
| | 11 | 134 | 86 |

From the results shown in Table 9 it is evident that in the valve seats 1 to 11 of the present invention produced by the processes 1 to 11 of the present invention, as shown in Table 4, the diffusion and migration of the Co, Cr and Si components from the raw material powder for forming the hard dispersion phase into the matrix during sintering, together with the diffusion and migration of the Fe component from the raw material powder for forming the matrix into the gaps left by the migration and diffusion of the Co, Cr and Si components into the matrix, produce an extremely powerful adhesion of the hard dispersion phase to the matrix. Accordingly, all of these valve seats display excellent wear resistance under conditions of high surface pressure application. In addition, the 2 phase mixed system of the hard dispersion phase ensures smaller counterpart attack properties, ensuring that wear of the valves, which represent the counterparts, is also minimal. In contrast, in the comparative valve seats 1 to 11 produced by the comparative processes 1 to 11, as shown in Table 8, there is almost no variation in the compositions of the hard dispersion phase and the matrix of the Fe-based sintered alloy that forms the valve seat, between the state prior to sintering and that following sintering, indicating that during sintering, essentially no diffusion and migration of structural components occurred between the raw material powder for forming the matrix and the raw material powder for forming the hard dispersion phase. As a result, the adhesion of the hard dispersion phase to the matrix is relatively weak. Accordingly, wearing of each of these valve seats under conditions of high surface pressure application proceeds rapidly, and because the hard dispersion phase is extremely hard, counterpart attack becomes a significant problem.

As described above, according to a process of the present invention, a valve seat can be produced that exhibits excellent wear resistance and displays little counterpart attack when utilized under conditions of high surface pressure application, thereby providing a valve seat that can satisfy the demands associated with the increased size and output of internal combustion engines.

What is claimed is:

1. A process for producing an Fe-based sintered alloy valve seat comprising the steps of:

(a) using, as a raw material powder for forming a matrix, an Fe-based alloy powder comprising, in terms of weight percentage, C: 0.5 to 1.5%, Ni: 0.1 to 3%, Mo: 0.5 to 3%, Co: 3 to 8%, Cr: 0.2 to 3%, and a balance of Fe and inevitable impurities, and having an average particle size of 20 to 50 μm; and using, as a raw material powder for forming a hard dispersion phase, a Co-based alloy powder comprising, on a weight percentage basis, Mo: 20 to 32%, Cr: 5 to 10%, Si: 0.5 to 4%, and a balance of Co and inevitable impurities, and having an average particle size of 20 to 50 $\mu$m, (b) conducting solid phase sintering, under vacuum conditions, of a pressed compact formed from a mixed powder generated by mixing said Co-based alloy powder into said Fe-based alloy powder in sufficient quantity to account for 25 to 35% by weight of a combined weight with said Fe-based alloy powder, and causing said Co, Cr and Si components of said Co-based alloy powder to diffuse and migrate into said matrix, and said Fe component of said Fe-based alloy powder to diffuse and migrate concurrently into said hard dispersion phase, thereby markedly improving adhesion of said hard dispersion phase to said matrix, and forming, as a result, an Fe-based sintered alloy substrate with a porosity of 10 to 20%, and comprising, according to measurements performed using an X-ray microanalyzer (EPMA), an Fe—Co alloy matrix comprising, in terms of weight percentage, C: 0.5 to 1.5%, Ni: 0.1 to 3%, Mo: 0.5 to 3%, Co: 13 to 22%, Cr: 1 to 5%, Si: 0.1 to 1%, and a balance of Fe and inevitable impurities, in which is uniformly distributed a hard dispersion phase of a Mo—Fe—Co alloy, having a composition comprising, in terms of weight percentage, Fe: 20 to 30%, Co: 13 to 22%, Cr: 1 to 5%, Si: 0.3 to 3%, and a balance of Mo and inevitable impurities, and having a 2 phase mixed system of an Fe—Co alloy phase and a Mo—Co alloy phase, and (c) infiltrating said Fe-based sintered alloy substrate with copper or a copper alloy.

2. A valve seat obtainable by the process as defined in claim 1.

* * * * *